US005112628A

United States Patent [19]

Conrad

[11] Patent Number: 5,112,628

[45] **Date of Patent: * May 12, 1992**

[54] NIPPLE FITMENT WITH SAFETY OVERCAP

[75] Inventor: George R. Conrad, Dunwoody, Ga.

[73] Assignee: General Electric Company, Mt. Vernon, Ind.

[ * ] Notice: The portion of the term of this patent subsequent to May 16, 2006 has been disclaimed.

[21] Appl. No.: 538,594

[22] Filed: Jun. 14, 1990

Related U.S. Application Data

[63] Continuation of Ser. No. 289,936, Dec. 27, 1988, abandoned.

[51] Int. Cl.[5] ..... B65D 41/04; B65D 41/34; B65D 49/12; A61J 9/00

[52] U.S. Cl. ..... 426/117; 426/87; 426/115; 426/131; 215/11.1; 215/276; 215/258; 215/271

[58] Field of Search ..... 426/117, 115, 87, 131; 215/11.1–11.6, 271, 276, 252, 258

[56] References Cited

U.S. PATENT DOCUMENTS

| | | | |
|---|---|---|---|
| 225,752 | 3/1880 | Griswold et al. | 220/DIG. 16 |
| 1,570,732 | 1/1926 | Emerson | 220/DIG. 16 |
| 2,027,430 | 1/1936 | Hansen | 220/DIG. 16 |
| 2,040,798 | 1/1936 | Schoonmaker | 220/DIG. 16 |
| 2,519,986 | 8/1950 | Trout | 215/11.1 |
| 2,643,785 | 6/1953 | Rust | 215/11.3 |
| 2,746,631 | 5/1956 | Witz | 215/11.1 |
| 2,796,188 | 6/1957 | Kurkjian | 215/11.1 |
| 2,843,281 | 7/1958 | Gallois | 215/11.1 |
| 2,864,520 | 12/1958 | Pitavy | 215/11.1 |
| 3,307,728 | 3/1967 | Elser | 215/276 |
| 3,329,295 | 7/1967 | Fields | 215/252 |
| 3,393,817 | 7/1968 | Meierhoefer | 215/11.6 |
| 3,746,198 | 7/1973 | Howland | 215/11.6 |
| 3,770,154 | 11/1973 | Johnson | 215/11.3 |
| 3,779,413 | 12/1973 | Pickerell | 426/117 |
| 3,804,952 | 4/1974 | MacDonald | 426/117 |
| 3,944,102 | 3/1976 | Grau | 215/258 |
| 4,533,059 | 8/1985 | Kapolas et al. | 215/276 |
| 4,567,993 | 2/1986 | Albrecht et al. | 215/258 |
| 4,669,623 | 6/1987 | Csaszar | 215/258 |
| 4,765,498 | 8/1988 | Rafferty | 215/271 |
| 4,807,770 | 2/1989 | Barriac | 215/276 |
| 4,809,858 | 3/1989 | Ochs | 215/276 |
| 4,813,561 | 3/1989 | Ochs | 215/276 |
| 4,830,251 | 5/1989 | Conrad | 215/11.6 |

*Primary Examiner*—Steven Weinstein
*Attorney, Agent, or Firm*—Joseph T. Eisele; Martin B. Barancik

[57] ABSTRACT

A bottle feeder comprises a tamper evident overcap, which captures a nipple and hold-down cap and has a pop-up indicator to insure the integrity of the bottle is discribed. Upon removal of the overcap the tamper evident band remains on the bottle and the pop-up indicator indicates the feeder has been opened. The nipple and hold-down cap can be withdrawn from the overcap and placed on the bottle for use.

2 Claims, 1 Drawing Sheet

FIG. 1
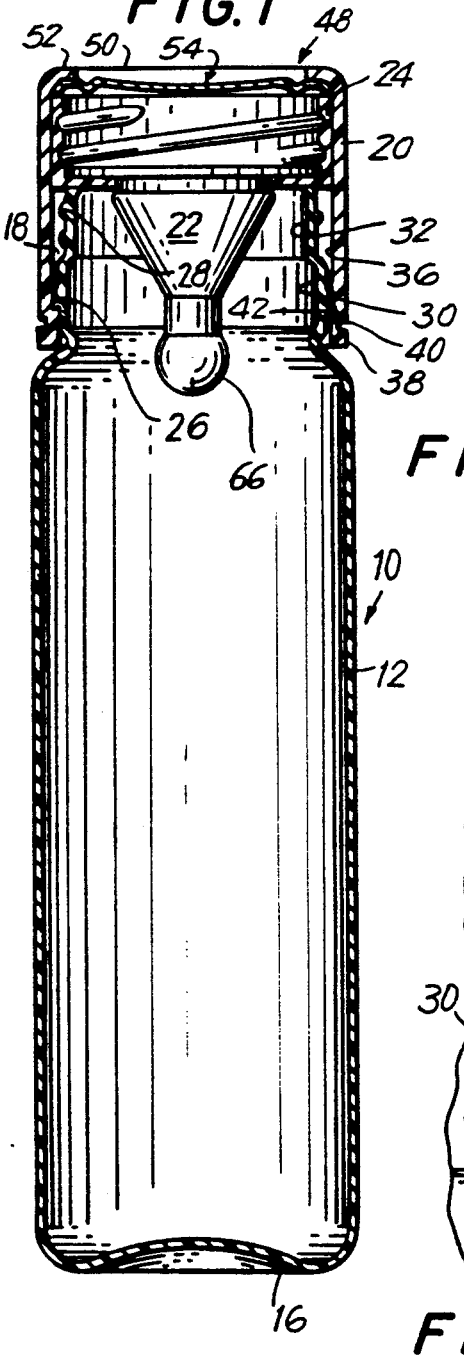
FIG. 2
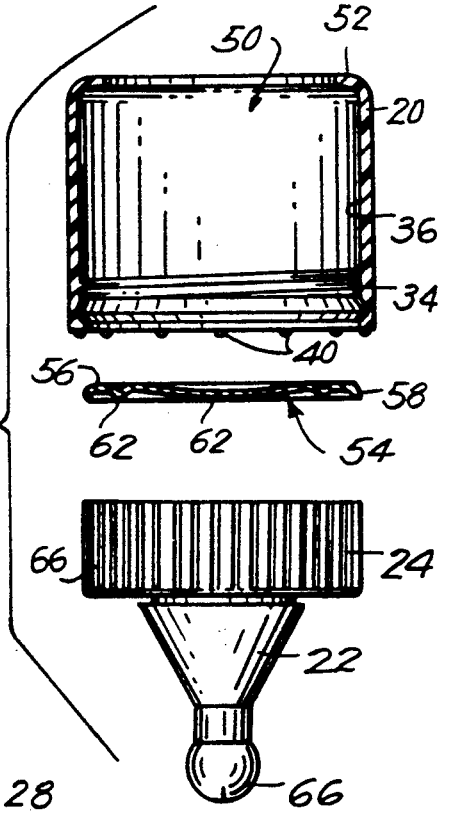
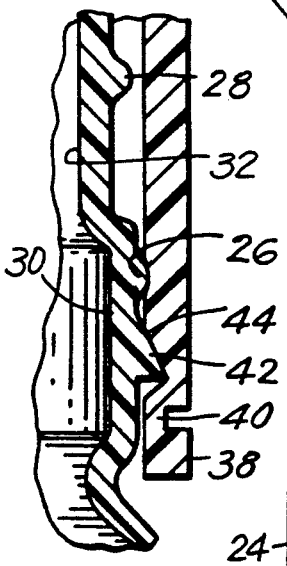
FIG. 4
FIG. 3
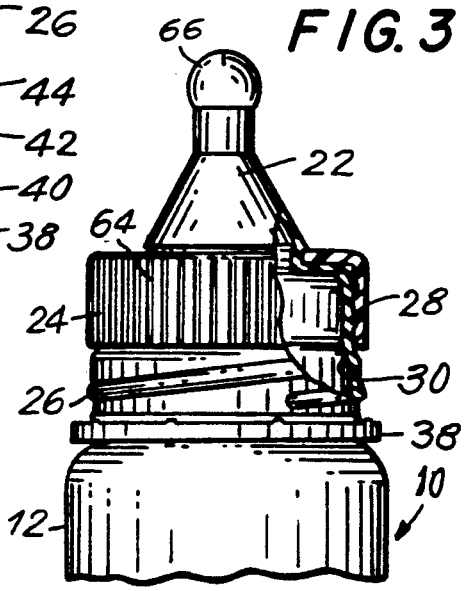

NIPPLE FITMENT WITH SAFETY OVERCAP

This is a continuation of co-pending application Ser. No. 289,936 filed on Dec. 27, 1988 now abandoned.

FIELD OF INVENTION

The present invention relates to a bottle feeder, particularly one in which there is a tamper evident feature to indicate when tampering has occurred.

BACKGROUND AND SUMMARY OF THE INVENTION

There exist many different bottle feeders on the market some of which are available with product already contained therein. Others are sold empty and the consumer fills them for use. In either situation but more so as to the former where baby formulae, or the like may be involved, it is important that the integrity of the product is assured. In this regard, it is desirable that the content of the bottle be maintained in a vacuum as is common in the packaging of food.

Typically, in the sale of baby formulae, juice or the like where a bottle container is used, the bottle is sold without the nipple. This requires the separate purchase of a nipple and a hold-down cap which is used to secure the nipple on the bottle. This is obviously not as convenient as the purchasing of a single self-contained unit which includes the nipple component.

While such a single unit is desirable, it is also desirable that the contents of the bottle be maintained in a vacuum prior to use to insure the quality of the product. While the placing of the content of a bottle under negative pressure is readily attended to, the combination of bottle and nipple will obviously be more complicated. Accordingly, it is an object of the invention to provide for a feeder bottle wherein a combination bottle and nipple are sold as a unit with a tamper evident overcap. It is preferred to provide such a unit which will include the product or formulae to be dispensed.

It is further preferred to provide such a unit vacuumed packed with an indicator to indicate when the vacuum seal is broken.

The present invention provides a bottle feeder which includes both a bottle and nipple in a tamper evident vacuum sealed arrangement. In this regard the bottle includes two threaded portions—one on top of the other. The lower thread is for securing a plastic overcap which will contain the nipple therein along with a hold down cap.

The overcap is threaded down on the bottle neck resulting in a tamper evident band being captured by a retaining means. The contents of the bottle along with the overcap is placed in a vacuum. Provided in the overcap is a metal button down "dud detector" or "pop-up" indicator which serves to indicate when the vacuum seal of the unit has been broken. This may occur as a result of improper packaging, spoilage, defects or tampering. In addition, the tamper evident band will indicate whether the overcap has been removed. Accordingly, this arrangement serves to provide two means of indicating tampering and/or defective sealing.

If the condition of the unit is satisfactory, the overcap may be unscrewed and the nipple and hold-down cap withdrawn and threaded down on the upper set of threads prior to use.

BRIEF DESCRIPTION OF THE DRAWINGS

Thus by the present invention, its objects and advantages will be realized, the description of which should be taken in conjunction with a viewing of the drawings, wherein:

FIG. 1 is a side, partially sectional view of an embodiment bottle feeder after being filled with product, incorporating the teachings of the present invention;

FIG. 2 is side, partially sectional view showing the overcap with the nipple removed therefrom, incorporating the teachings of the present invention;

FIG. 3 is a side, partially sectional view of the bottle feeder after being opened and showing the nipple attached to the bottle prior to use, incorporating the teachings of the present invention; and FIG. 4 is an enlarged, partially sectional view of the tamper evident portion of the feeder incorporating the teachings of the present invention.

DETAILED DESCRIPTION OF THE PREFERRED EMBODIMENTS OF INVENTION

Turning to the drawings, there is seen a bottle feeder 10 for use in feeding infants. Referring first to FIG. 1, in a cross-sectional side elevation, it is seen that the feeder 10 includes a bottle portion 12 which may be cylindrical in shape and can be sized so as to accommodate various quantities of liquids as desired. The bottle 12 includes a closed base 16 on one end and an open neck portion 18 on its opposite end. As shown in FIG. 1, positioned on the neck portion 18 is an overcap 20 which serves to contain therein a nipple 22 and hold-down cap 24. Located on the outside of the neck portion 18 are two helical threads 26 and 28. Thread 26 is positioned on an enlarged portion 30 of the neck portion 18 with thread 28 on a portion 32 of the neck portion 18 having a reduced diameter. Thread 26 serves to engage a complimentary helical groove 34 positioned on the inner sidewall 36 of the overcap 20 (see FIG. 2). Thread 26 and groove 34 together provide a means for threading the overcap 20 on and off the bottle 12 neck portion 18.

Referring again to FIG. 1, positioned at the lower end of side wall 36 of overcap 20 is a tamper evident band 38 which is coupled to the sidewall 36 by way of a plurality of spaced frangible members or ribs 40. Members 40 (best seen in FIG. 2 and in FIG. 4 following their fracture to open the joinder between overcap 20 and band 38) may be made out of the same material as the overcap 20 which is preferably plastic and may be opaque or preferably transparent.

Referring again to the enlarged view of FIG. 4, one may see positioned on the neck portion 18 of the bottle 12 beneath threads 26 and 28, a retaining means 42 positioned about the circumference of the neck portion 18. The retaining means 42 comprises a tapered surface 44 which terminates in a flat surface 46 which is perpendicular to the neck portion 18.

When the overcap 20 is threaded down beyond a selected pre-determined point onto the bottle feeder 10, as shown in FIG. 1, the internal surface of band 38 engages surface 44 and is gradually expanded until the inner surface of band 38 snaps under surface 46. At this point, thread 26 and groove 34 form a pressure seal to maintain a vacuum in the bottle 12. Then, a threading off of the overcap 20 results in the retaining means 42 engaging band 38 and fracturing members 40. The tamper evident band 38 remains on the neck portion 18 as shown in FIG. 3, providing evidence that the overcap 20 has been removed. This is a "tamper-evident" indication.

Located at the top 48 of overcap 20 is a circular opening 50 defined by flange 52. Positioned adjacent the flange 52 and within the overcap 20 is a circular button-down dud detector 54 which is preferably made of metal. Detector 54 (see FIG. 2) includes a flat outer flange 56 with a beveled edge 58 which engages with the underside of flange 52. A circular groove 60 is provided in the detector 54 defining a flexible circular area 62. Area 62 serves as a second indicator whether the vacuum integrity of the feeder has or has not been disturbed. In this regard, once the liquid contents of the feeder 10 have been placed in bottle 12 and the overcap 20 has been fitted thereon, the interior of the feeder is placed under a negative pressure or vacuum. This causes the dud detector 54, particularly the center circular area 62, to flex downward into a recessed positioned within overcap 20. Once the overcap 20 is unthreaded to a point that the vacuum seal is broken, area 62 pops up indicating that the contents are no longer under vacuum seal. Of course if for any other reason the vacuum seal is broken (a crack in the container, improper sealing during packaging, etc.) the dud detector 54 will indicate this by either popping up or not taking the recessed position in the first place.

Positioned within the overcap 20 is the nipple 22 and hold-down cap 24 which can be removed by pressing down on detector 54 through opening 50, forcing detector 54 out as shown in FIG. 2 and pushing cap 24 and nipple 22 ahead of it. As aforesaid, removal of the overcap 20 in addition to causing a break in the vacuum seal also results in the fracture of the frangible members 40 causing the tamper evident band 38 to be captured by the retaining means 42, also providing an indication that the product has been opened.

Once removed, the nipple 22 and hold-down cap 24 may be then inverted and threaded down on the neck portion 18 as shown in FIG. 3. Note that about the outer surface of the hold-down cap 24 is a plurality of grooves or channels 64 extending the length thereof. These grooves 64 not only facilitate the finger grasping of the cap 24, but also serve as a channel means of allowing the application of vacuum by way of the top of the overcap 20 via opening 50 to penetrate to the interior of the bottle 12 past cap 24 when it is positioned within overcap 20 as shown in FIG. 1. The opening 66 in nipple 22 also facilitate this.

Thus by the present invention its objects and advantages are realized and although a preferred embodiment has been disclosed and described in detail herein, its scope should not be limited thereby rather its scope should be determined by that of the appended claims.

What is claimed is:

1. A hermetically sealed bottle feeder of drinkable liquid that is under vacuum comprising:

a container holding a liquid under vacuum, said container having a cylindrical neck with an opening therein to allow the ingress and egress of said liquid, said neck including a top and a first helical thread located on said neck;

an overcap mounted on said neck and comprising a downwardly extending vertical side wall coupled to at its lower end a tamper evident band by a frangible portion and said overcap having at its upper end a horizontally directed flange extending perpendicularly to said side wall and defining an overcap opening on the top of said overcap, said side wall having a complimentary helical groove for engagement with said first helical thread;

said first thread cooperating with said overcap to form a vacuum seal for said container;

said container neck further including below said first helical thread, retainer means for retaining said tamper evident band on said neck when said overcap is removed by causing the frangible portion to fracture detaching the band from the sidewall;

said overcap and said container defining an enclosed vacuum space;

a nipple and a hold-down cap captured between said overcap and said neck and secured in said enclosed vacuum space by the overcap, said hold-down cap having an upper end containing said nipple and a lower end with said lower end having means to receive and be coupled with corresponding means on the neck of said container for dispensing the contents thereof;

said overcap being screwed down onto the container with the hold-down cap in inverted position with its normally upper end pressed down on the top of the neck of the bottle and its normally lower end directed upwardly;

vacuum seal indicating means comprising a downwardly bowed disc covering said opening in the overcap to seal said container;

said vacuum seal indicating means extending across and below the opening in the overcap and being completely extensive with the opening in the overcap; and wherein said overcap secures the vacuum seal indicating means to the upwardly directed end of the inverted overcap which itself is tightly and hermetically sealed to the upper edge of the container.

2. The bottle feeder of claim 1 wherein said corresponding means on the neck of said container further comprises a second helical thread disposed on said neck above said first helical thread, and wherein said means to receive and be coupled with on said hold-down cap comprises a third helical thread for mounting said nipple on said neck by engagement between said second and third helical threads after said overcap has been removed.

* * * * *